US012295435B2

(12) United States Patent
Yonemitsu

(10) Patent No.: US 12,295,435 B2
(45) Date of Patent: May 13, 2025

(54) ANTISTATIC GLOVE

(71) Applicant: SHOWA GLOVE CO., Himeji (JP)

(72) Inventor: Hosei Yonemitsu, Himeji (JP)

(73) Assignee: Showa Glove Co., Himeji (JP)

( * ) Notice: Subject to any disclaimer, the term of this patent is extended or adjusted under 35 U.S.C. 154(b) by 0 days.

(21) Appl. No.: 18/464,784

(22) Filed: Sep. 11, 2023

(65) Prior Publication Data

US 2024/0130454 A1 Apr. 25, 2024
US 2024/0225154 A9 Jul. 11, 2024

(30) Foreign Application Priority Data

Oct. 20, 2022 (JP) ..... 2022-168127
Jun. 13, 2023 (JP) ..... 2023-096758

(51) Int. Cl.
*A41D 19/015* (2006.01)
*A41D 19/00* (2006.01)
(Continued)

(52) U.S. Cl.
CPC ..... *A41D 19/015* (2013.01); *A41D 19/0044* (2013.01); *D02G 3/045* (2013.01);
(Continued)

(58) Field of Classification Search
CPC ..... A41D 19/015; A41D 13/008; D02G 3/44; D02G 3/441
See application file for complete search history.

(56) References Cited

U.S. PATENT DOCUMENTS

RE37,430 E * 10/2001 Toon ..... A41D 31/26 428/401
6,941,775 B2 9/2005 Sharma
(Continued)

FOREIGN PATENT DOCUMENTS

EP 2 814 349 B1 12/2014
JP S57-161899 U 10/1982

*Primary Examiner* — Jillian K Pierorazio
(74) *Attorney, Agent, or Firm* — Norris McLaughlin, P.A.

(57) ABSTRACT

An aspect of the present invention is a glove including: a glove main body knitted with a yarn made of fiber, the glove main body including: a main body portion; five finger-receiving portions each having a bottomed cylindrical shape; and a cylindrical cuff portion, wherein in at least a part of a palm part, the main body portion has a repeating structure of: a strip-shaped electrically conductive part containing an electrically conductive yarn; and a strip-shaped electrically non-conductive part not containing the electrically conductive yarn, a ratio of the number of courses of the electrically conductive part to the number of courses of the electrically non-conductive part, the electrically conductive part and the electrically non-conductive part being adjacent to each other, is no less than 1:2 and no greater than 1:6, the electrically conductive part is constituted by plating knitting of the electrically conductive yarn and an electrically non-conductive plating yarn, a fineness ratio of the electrically conductive yarn to the plating yarn is no less than 1:0.5 and no greater than 1:2, and a fineness ratio of an electrically non-conductive yarn, which constitutes the electrically non-conductive part, to the electrically conductive yarn contained in the electrically conductive part is no less than 1:0.4 and no greater than 1:1.

7 Claims, 6 Drawing Sheets

(51) Int. Cl.

| | |
|---|---|
| ***D02G 3/04*** | (2006.01) |
| ***D02G 3/32*** | (2006.01) |
| ***D02G 3/36*** | (2006.01) |
| ***D02G 3/44*** | (2006.01) |

(52) U.S. Cl.
CPC ..... *D02G 3/32* (2013.01); *D02G 3/36* (2013.01); *D02G 3/441* (2013.01); *A41D 2400/00* (2013.01); *A41D 2500/10* (2013.01); *D10B 2331/02* (2013.01); *D10B 2331/04* (2013.01); *D10B 2331/10* (2013.01); *D10B 2401/16* (2013.01); *D10B 2501/041* (2013.01)

(56) References Cited

U.S. PATENT DOCUMENTS

| | | | | |
|---|---|---|---|---|
| 7,348,059 | B2 * | 3/2008 | Zhu | D02G 3/047 57/252 |
| 9,587,333 | B1 * | 3/2017 | Ellsworth | D04B 1/28 |
| 10,701,992 | B2 | 7/2020 | Thompson et al. | |
| 2006/0264137 | A1 * | 11/2006 | Ishihara | D04B 1/14 442/317 |
| 2009/0145533 | A1 * | 6/2009 | Karayianni | D02G 3/441 156/47 |
| 2013/0076699 | A1 * | 3/2013 | Spencer | D03D 1/0088 57/244 |
| 2013/0105215 | A1 * | 5/2013 | Morris | H05K 9/0098 174/394 |
| 2013/0205469 | A1 * | 8/2013 | Thompson | D04B 1/102 2/163 |
| 2014/0157832 | A1 * | 6/2014 | Thompson | D04B 1/28 66/65 |
| 2015/0181956 | A1 * | 7/2015 | Andrews | A41D 19/0006 2/167 |
| 2015/0376821 | A1 * | 12/2015 | McMaster | D04B 1/14 66/202 |
| 2016/0209921 | A1 * | 7/2016 | Spencer | G06F 3/044 |
| 2017/0035605 | A1 * | 2/2017 | Estreicher | D04B 1/28 |
| 2017/0327377 | A1 * | 11/2017 | Zhang | D06M 15/256 |
| 2017/0350044 | A1 * | 12/2017 | Sugita | D02G 3/12 |
| 2018/0027902 | A1 * | 2/2018 | Thompson | A41D 19/015 |
| 2018/0347081 | A1 * | 12/2018 | Kurahashi | D04B 1/18 |
| 2019/0282165 | A1 * | 9/2019 | Hamdani | A61B 5/6807 |
| 2020/0345083 | A1 * | 11/2020 | Threlkeld | D02G 3/441 |
| 2021/0195971 | A1 * | 7/2021 | Andrews | A41D 19/01547 |
| 2021/0277544 | A1 * | 9/2021 | King | D04B 1/24 |
| 2022/0003613 | A1 * | 1/2022 | Chahine | D04B 21/20 |

* cited by examiner

ANTISTATIC GLOVE

BACKGROUND OF THE INVENTION

Field of Invention

The present invention relates to a glove.

Description of the Related Art

As a working glove, one eliminating electrification is known (for example, see Japanese Examined Utility Model Application Publication No. S57-161899). Such a working glove has electrical conductivity and enables reducing risks of work in a combustible or explosive atmosphere and/or inhibiting electrostatic breakdown of an electronic device as an object for gripping.

On the other hand, when a resistance value of the glove becomes too low, for example, a worker may be electrically shocked, and in a case of gripping an electronic device, an electrical short circuit failure may be caused. Thus, the working glove is made to be a so-called antistatic glove in which electrically conductive fiber is used together with electrically non-conductive fiber and an amount of the electrically conductive fiber is adjusted such that a desired electrical resistance value is obtained as a whole.

PRIOR ART DOCUMENTS

Patent Documents

[Patent Document 1] Japanese Examined Utility Model Application Publication No. S57-161899

SUMMARY OF THE INVENTION

In the conventional antistatic glove, a content of the electrically conductive fiber is approximately 0.01% by mass to 5% by mass. It is considered that this content corresponds to a proportion of a surface area of the glove; therefore, of the surface of the glove, a part exhibiting electrical conductivity accounts for no greater than 5%. For example, if an object for gripping is large and needs to be gripped by the entire palm, desired antistatic performance can be obtained; however, in a case of an object having a fine structure, such as that of a precision electronic device, the part exhibiting electrical conductivity does not necessarily come into contact with the fine structure, and an effect of inhibiting electrostatic breakdown may not be obtained. Conversely, when the part exhibiting electrical conductivity comes into contact with the fine structure, an electrically non-conductive part becomes relatively small and a resistance becomes too low, which may cause an electrical short circuit failure.

Thus, microscopically, it cannot be said that in the conventional antistatic glove, the electrical resistance value is sufficiently controlled. In other words, in the conventional antistatic glove, it is difficult to stably obtain a desired resistance value depending on a contact position with an object for gripping.

The present invention was made in view of the foregoing circumstances, and an object of the invention is to provide, while inhibiting a rise in manufacturing cost, a glove having a volume resistance value that easily falls within a certain range, even when a contact position with an object for gripping varies.

To provide an electrically conductive part to which electrical conductivity is imparted, it is necessary for electrically conductive yarns to be exposed on a glove outer face and a glove inner face in the electrically conductive part, and for the electrically conductive yarn exposed on the glove outer face to continue to the electrically conductive yarn exposed on the glove inner face to form an electrically conductive path. On the other hand, when the electrically conductive path increases in number, the volume resistance value decreases more than is needed. In general, a glove is knitted by flat knitting or plating knitting. In a case of flat knitting with one type of yarn, the electrically conductive yarn is used in an entire face of the glove, and the electrically conductive yarns are exposed on the outer face and the inner face of the glove, whereby the volume resistance value is excessively decreased. In this case, an approach of controlling the resistance value of the electrically conductive yarn itself may be considered; however, a special yarn needs to be used, which is likely to lead to a rise in manufacturing cost. On the other hand, in a case of plating knitting with a pair of yarns, the excessive decrease in the volume resistance value can be inhibited by plating knitting of the electrically conductive yarn and an electrically non-conductive yarn; however, the electrically conductive yarn is exposed on either the outer face or the inner face of the glove, and this time, the volume resistance value becomes too high. Thus, in the glove to which electrical conductivity is imparted, it is difficult to prevent the excessive decrease in the volume resistance value of the electrically conductive part, and typically, the lower limit of the volume resistance value is not controlled. Thus, the inventors of the present invention concluded that a factor in the volume resistance value greatly changing depending on the contact position with an object for gripping is that the volume resistance value of the electrically conductive part decreases more than is needed, and that a proportion of the electrically non-conductive part increases to compensate for this.

As a result of intensive studies for removing the above-described factor, the inventors of the present invention found that by constituting the electrically conductive part by plating knitting of the electrically conductive yarn and the electrically non-conductive plating yarn, and by appropriately controlling a yarn used in the electrically non-conductive part adjacent to the electrically conductive part, the volume resistance value of the electrically conductive part can be controlled to be an appropriate value, i.e., the volume resistance value can be controlled not to excessively decrease, while maintaining electrical conductivity. By thus reducing the proportion of the electrically non-conductive part, the inventors of the present invention completed the glove of the present invention, which has a volume resistance value that easily falls within a certain range, even when the contact position with an object for gripping varies.

That is to say, an aspect of the present invention is a glove including: a glove main body knitted with a yarn made of fiber, the glove main body including: a main body portion; five finger-receiving portions each having a bottomed cylindrical shape; and a cylindrical cuff portion, wherein the main body portion is formed into a bag shape to cover a palm and a dorsal side of a wearer's hand, the five finger-receiving portions extend from the main body portion to cover each of a first finger to a fifth finger of the wearer, and the cuff portion extends in a direction opposite to the five finger-receiving portions, in at least a part of a palm part, the main body portion has a repeating structure of: a strip-shaped electrically conductive part containing an electrically conductive yarn; and a strip-shaped electrically non-conductive part not containing the electrically conductive yarn, a ratio of the number of courses of the electrically conductive part to the number of courses of the electrically non-conductive part, the electrically conductive part and the electrically non-conductive part being adjacent to each other, is no less than 1:2 and no greater than 1:6, the electrically conductive part is constituted by plating knitting of the electrically conductive yarn and an electrically non-conductive plating yarn, a fineness ratio of the electrically conductive yarn to the plating yarn is no less than 1:0.5 and no greater than 1:2, and a fineness ratio of an electrically non-conductive yarn, which constitutes the electrically non-conductive part, to the electrically conductive yarn contained in the electrically conductive part is no less than 1:0.4 and no greater than 1:1.

Effects of the Invention

While inhibiting a rise in manufacturing cost, the glove of the present invention has a volume resistance value that easily falls within a certain range, even when the contact position with an object for gripping varies.

DESCRIPTION OF THE PREFERRED EMBODIMENTS

Figure 1:
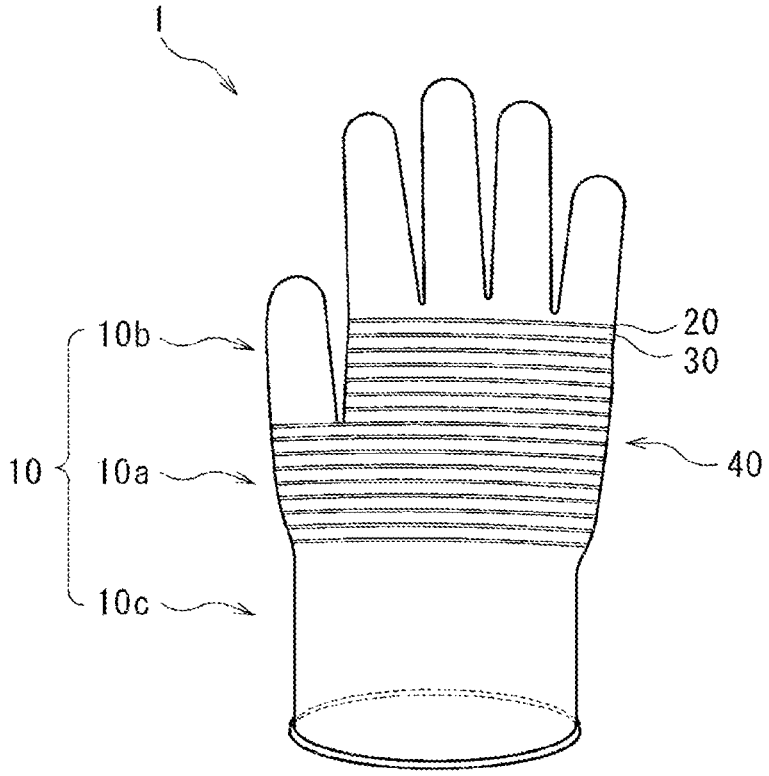
FIG. 1 is a schematic perspective view from a palm side of a glove according to an embodiment of the present invention.

Description of Embodiments of the Present Invention

Firstly, embodiments of the present invention are listed and described.

An aspect of the present invention is a glove including: a glove main body knitted with a yarn made of fiber, the glove main body including: a main body portion; five finger-receiving portions each having a bottomed cylindrical shape; and a cylindrical cuff portion, wherein the main body portion is formed into a bag shape to cover a palm and a dorsal side of a wearer's hand, the five finger-receiving portions extend from the main body portion to cover each of a first finger to a fifth finger of the wearer, and the cuff portion extends in a direction opposite to the five finger-receiving portions, in at least a part of a palm part, the main body portion has a repeating structure of: a strip-shaped electrically conductive part containing an electrically conductive yarn; and a strip-shaped electrically non-conductive part not containing the electrically conductive yarn, a ratio of the number of courses of the electrically conductive part to the number of courses of the electrically non-conductive part, the electrically conductive part and the electrically non-conductive part being adjacent to each other, is no less than 1:2 and no greater than 1:6, the electrically conductive part is constituted by plating knitting of the electrically conductive yarn and an electrically non-conductive plating yarn, a fineness ratio of the electrically conductive yarn to the plating yarn is no less than 1:0.5 and no greater than 1:2, and a fineness ratio of an electrically non-conductive yarn, which constitutes the electrically non-conductive part, to the electrically conductive yarn contained in the electrically conductive part is no less than 1:0.4 and no greater than 1:1.

In the glove, the electrically conductive yarn and the electrically non-conductive plating yarn of the electrically conductive part are subjected to plating knitting, and the fineness ratio thereof falls within the above range. In this case, when the electrically conductive part comes into contact with an object for gripping, the electrically conductive yarn is exposed on both an outer face and an inner face of the glove due to deformation of the electrically conductive yarn and the plating yarn, whereby electrical conductivity between the outer face and the inner face of the glove can be ensured. Furthermore, in the glove, by setting the fineness ratio of the electrically non-conductive yarn, which constitutes the electrically non-conductive part, to the electrically conductive yarn contained in the electrically conductive part to fall within the above range, when the electrically conductive part comes into contact with an object for gripping, strong contact of the electrically conductive yarn with the object for gripping and/or a hand of a worker can be inhibited, and an excessive decrease in the volume resistance value of the electrically conductive part can be inhibited. Thus, in the glove, the electrically conductive part can be disposed such that the ratio of the number of courses of the electrically conductive part to the number of courses of the electrically non-conductive part, the electrically conductive part and the electrically non-conductive part being adjacent to each other, falls within the above range, i.e., the electrically conductive part can be repeatedly disposed at an appropriate frequency; therefore, even when the contact position with the object for gripping varies, the volume resistance value of the repeating structure easily falls within the certain range. Furthermore, the glove does not require use of a special yarn and thus enables inhibiting a rise in manufacturing cost.

The number of courses of the electrically conductive part is preferably no less than 1 course and no greater than 3 courses. By thus setting the number of courses of the electrically conductive part to fall within the above range, an interval between the electrically conductive parts is narrowed, whereby a change in the volume resistance value depending on the contact position with an object for gripping can be inhibited.

It is preferable that the electrically conductive yarn is a core-sheath composite yarn, that a core yarn of the core-sheath composite yarn is constituted by electrically non-conductive elastic fiber, and that a sheath yarn contains electrically conductive fiber. By thus using the core-sheath composite yarn as the electrically conductive yarn and using the electrically non-conductive elastic fiber as the core yarn of the core-sheath composite yarn, the electrically conductive yarn can be easily deformed, and when the electrically conductive part comes into contact with an object for gripping, the electrically conductive fiber contained in the sheath yarn comes into contact with the object for gripping or a hand of a worker, whereby electrical conductivity can be easily ensured.

It is preferable that the elastic fiber is nylon fiber or polyester fiber subjected to crimping, and that an elongation rate of the elastic fiber is no less than 10% and no greater than 100%. By thus using the nylon fiber or the polyester fiber subjected to crimping as the elastic fiber and setting the elongation rate of the elastic fiber to fall within the above range, electrical conductivity can be ensured more easily.

The plating yarn is preferably an elastic yarn. By thus using the elastic yarn as the plating yarn, the plating yarn as well as the electrically conductive yarn can be easily deformed. When the electrically conductive part comes into contact with an object for gripping, deformation of the plating yarn allows the electrically conductive yarn to come into contact with the object for gripping and/or a hand of a worker, whereby electrical conductivity can be easily ensured.

The plating yarn is preferably a composite yarn containing spandex fiber or natural rubber fiber. By thus using, as the plating yarn, the composite yarn containing the spandex fiber or the natural rubber fiber, electrical conductivity can be ensured more easily.

In the repeating structure, a volume resistance value specified in EN 61340-2-3 is preferably no less than $3.5\times10^{3}\Omega$ and no greater than $1.0\times10^{8}\Omega$ By thus setting the volume resistance value with reference to EN 16350 to fall within the above range, both explosion-proof performance and protection of an electronic component can be easily achieved.

In the repeating structure, a surface resistance value specified in EN 61340-2-3 is preferably no less than $3.5\times10^{3}\Omega$ and no greater than $1.0\times10^{8}\Omega$ By thus setting the surface resistance value to fall within the above range, while maintaining performance for protecting an electronic component, the explosion-proof performance can be further improved, and operation of an electronic device such as a touch panel or the like can be facilitated.

As referred to herein, the "volume resistance value" and the "surface resistance value" are measured according to EN 61340-2-3:2016 8, which is an EN standard, and a measurement sample is cut out from a central portion of the repeating structure of the palm part for which electrical conductivity and an explosion-proof property are required. Furthermore, as referred to herein, the "elongation rate" of a yarn (fiber) is determined by placing marks having an interval of 20 cm therebetween on a 60 cm yarn in a state of hanging a weight of 0.075 g, reading the interval indicated by the marks when the weight is replaced with a weight of 6 g, and calculating an elongated rate according to the following formula.

[Elongation rate]=([interval (cm) at time of hanging weight of 6 g]−20)/20×100(%)

Details of Embodiments of the Present Invention

Hereafter, the glove according to an embodiment of the present invention is described with reference to the drawings as appropriate.

A glove 1 illustrated in FIG. 1 includes a glove main body 10 knitted with a yarn made of fiber.

The glove main body 10 includes a main body portion 10*a*, five finger-receiving portions 10*b* each having a bottomed cylindrical shape, and a cylindrical cuff portion 10*c*. The main body portion 10*a* is formed into a bag shape to cover a palm and a dorsal side of a wearer's hand. The five finger-receiving portions 10*b* extend from the main body portion 10*a* to cover each of a first finger to a fifth finger of the wearer. The cuff portion 10*c* extends in a direction opposite to the five finger-receiving portions 10*b*.

Repeating Structure

Figure 2:
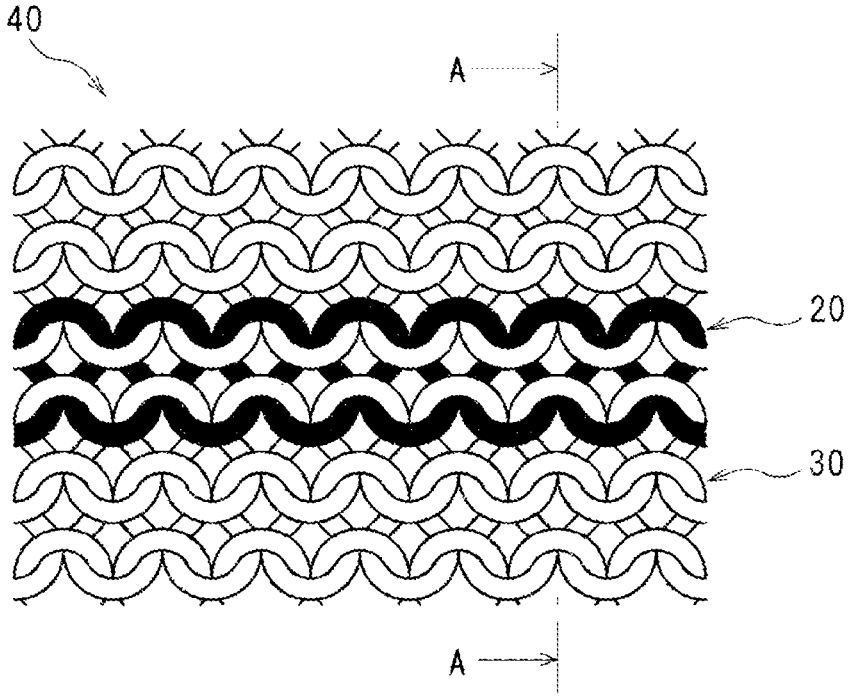
FIG. 2 is an enlarged schematic plan view of a repeating structure part in FIG. 1.
Figure 3:
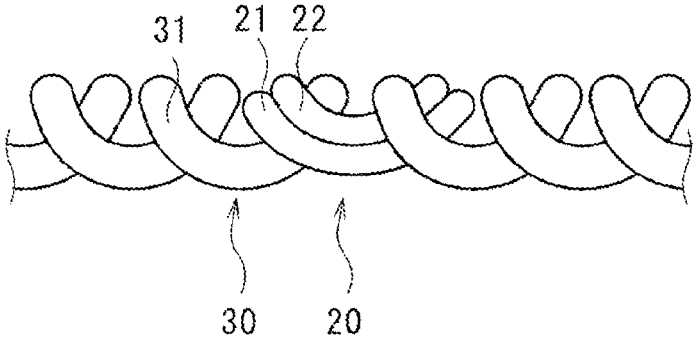
FIG. 3 is a schematic cross-sectional view taken along line A-A in FIG. 2.

As illustrated in FIGS. 2 and 3, in at least a part of a palm part, the main body portion 10*a* has a repeating structure 40 of: a strip-shaped electrically conductive part 20 containing an electrically conductive yarn 21; and a strip-shaped electrically non-conductive part 30 not containing the electrically conductive yarn 21.

As illustrated in FIG. 1, the repeating structure 40 is preferably provided to cover an entirety of the palm part. An object for gripping is held on the palm part in many cases, but an electronic component can be protected regardless of which site of the palm part abuts on the object for gripping. Furthermore, the repeating structure 40 may cover the dorsal side of the hand.

The lower limit of a ratio of the number of courses of the electrically conductive part 20 to the number of courses of the electrically non-conductive part 30, the electrically conductive part 20 and the electrically non-conductive part 30 being adjacent to each other, is 1:2 and more preferably 1:3. On the other hand, the upper limit of the ratio of the number of courses is 1:6, more preferably 1:5, and still more preferably 1:4. When the ratio of the number of courses is less than the lower limit, a volume resistance value of the repeating structure 40 may become too low, and an electrical short circuit failure may occur at a time of gripping an object for gripping. Conversely, when the ratio of the number of courses is greater than the upper limit, the volume resistance value of the repeating structure 40 becomes so high that the worker may be susceptible to electrification.

The number of courses of the electrically conductive part 20 is preferably no less than 1 course and no greater than 3 courses, more preferably no less than 1 course and no greater than 2 courses, and still more preferably 1 course. When the number of courses of the electrically conductive part 20 is thus set to fall within the above range, since the ratio of the number of courses of the electrically conductive part 20 to the number of courses of the electrically non-conductive part 30, the electrically conductive part 20 and the electrically non-conductive part 30 being adjacent to each other, is set to be no greater than 1:6 as described above, the number of courses of the electrically non-conductive part 30 is also no greater than a predetermined value (for example, no greater than 6 courses when the number of courses of the electrically conductive part 20 is 1 course). In other words, an interval between the electrically conductive parts 20 is narrowed. Accordingly, for example, such a situation in which only the electrically non-conductive part 30 comes into contact with an object for gripping hardly occurs, and a change in the volume resistance value depending on the contact position with the object for gripping can be inhibited.

In the repeating structure 40, the lower limit of the volume resistance value specified in EN 61340-2-3 is preferably $3.5\times10^{3}\Omega$ and more preferably 1.0×10 4Ω On the other hand, the upper limit of the volume resistance value is preferably $1.0\times10^{8}\Omega$ and more preferably 1.0×10 7Ω When the volume resistance value is less than the lower limit, an electrical short circuit failure may occur at the time of gripping an object for gripping. Conversely, when the volume resistance value is greater than the upper limit, the worker may be susceptible to electrification. Furthermore, when the volume resistance value is greater than $1.0\times10^{8}$ EN 16350 standard is not satisfied.

In the repeating structure 40, the lower limit of the surface resistance value specified in EN 61340-2-3 is preferably $3.5\times10^{3}\Omega$ and more preferably 1.0×10 4Ω The upper limit of the surface resistance value is preferably $1.0\times10^{8}\Omega$ and more preferably 1.0×10 7Ω By thus setting the surface resistance value to fall within the above range, while maintaining performance for protecting an electronic component, explosion-proof performance can be further improved, and operability of a touch panel can be improved.

Electrically Conductive Part

The electrically conductive part 20 is constituted by plating knitting of the electrically conductive yarn 21 and an electrically non-conductive plating yarn 22. In this case, the electrically conductive yarn 21 is knitted as a main yarn. Specifically, in the plating knitting, the electrically conductive yarn 21 is disposed on a face stich side, while the plating yarn 22 is disposed on a back stitch side.

The electrically conductive yarn 21 can be exemplified by a yarn containing electrically conductive fiber such as carbon composite organic fiber, metal oxide composite organic fiber, metal compound composite organic fiber, metal plating organic fiber, or the like, and for example, Clacarbo (registered trademark), manufactured by Kuraray Co., Ltd., Belltron (registered trademark), manufactured by SEIREN CO., LTD., Thunderon (registered trademark), manufactured by Nihon Sanmo Dyeing Co., Ltd., AGposs (registered trademark), manufactured by Mitsufuji Corporation, etc. may be used.

The lower limit of a fineness of a yarn consisting of such fiber is preferably 10 dtex and more preferably 20 dtex. On the other hand, the upper limit of the fineness of the yarn is preferably 50 dtex and more preferably 40 dtex. By setting the fineness of the yarn to fall within the above range, electrical conductivity of the repeating structure 40 can be ensured, strength of the glove 1 can be maintained, and manufacturing cost of the glove 1 can be suppressed. When the fineness of the yarn is less than the lower limit, strength of the glove 1 having been knitted, operability of a touch panel, or durability of the electrically conductive yarn may be degraded. Conversely, when the fineness of the yarn is greater than the upper limit, the resistance value may become too low and/or the manufacturing cost of the glove 1 may become too high.

Figure 4:
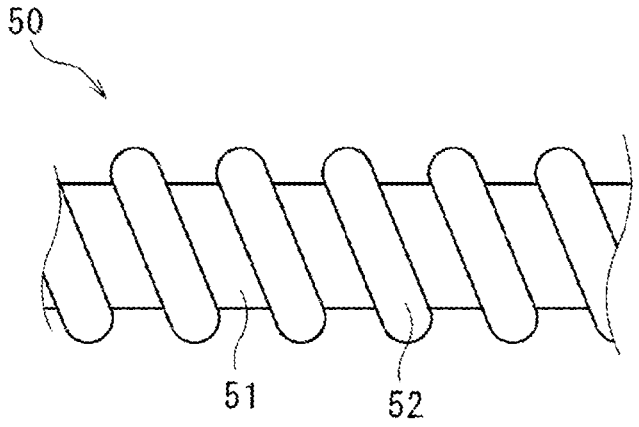
FIG. 4 is a schematic side view illustrating a configuration of a core-sheath composite yarn.

As the electrically conductive yarn 21, a yarn containing the above fiber may be used alone, but the electrically conductive yarn 21 may be a core-sheath composite yarn 50 as illustrated in FIG. 4. When the core-sheath composite yarn 50 is used as the electrically conductive yarn 21, the electrically conductive yarn 21 can be made thick, and thus, the strength of the glove 1 can be easily improved.

As illustrated in FIG. 4, the core-sheath composite yarn 50 is constituted by: an electrically non-conductive core yarn 51; and a sheath yarn 52 containing electrically conductive fiber.

Examples of a material of the core yarn 51 include cotton fiber, polyester fiber, nylon fiber, polyethylene fiber, polypropylene fiber, acrylic fiber, aramid fiber, polyparaphenylene benzoxazole (PBO) fiber, ultra-high molecular weight polyethylene fiber, highly drawn polyethylene fiber, glass fiber, polyurethane elastic fiber, and natural rubber fiber; composite fiber thereof; and the like.

In light of dust generation from the glove 1 being low, the core yarn 51 is preferably a filament yarn.

Furthermore, the core yarn 51 is preferably constituted by elastic fiber. By thus imparting elasticity to the core yarn 51, owing to shrinkage of the core yarn 51 after knitting, which is no longer under tension from a knitting machine, the carbon composite organic fiber, the metal oxide composite organic fiber, the metal compound composite organic fiber, or the metal plating organic fiber which is used for covering as the sheath yarn 52 is raised from the core-sheath composite yarn 50 and easily comes into contact with an object for gripping. Accordingly, electrical conductivity of the glove 1 is improved.

As the core yarn 51 having elasticity, aside from nylon fiber and polyester fiber subjected to crimping, a single covered yarn or a double covered yarn in which a spandex (polyurethane elastic fiber) or natural rubber fiber as a core yarn is covered with the nylon yarn or the polyester yarn described above may be used.

The lower limit of a fineness of the core yarn 51 is preferably 30 dtex and more preferably 50 dtex. On the other hand, the upper limit of the fineness of the core yarn 51 is preferably 166 dtex and more preferably 100 dtex. When the fineness of the core yarn 51 is less than the lower limit, the strength of the glove 1 having been knitted may be degraded. Conversely, when the fineness of the core yarn 51 is greater than the upper limit, it may be difficult to ensure flexibility of the glove 1, the glove 1 having been knitted may be stiff, and workability may be degraded.

In a case in which the core yarn 51 is constituted by electrically non-conductive elastic fiber, the lower limit of an elongation rate of the core yarn 51 is preferably 10%, more preferably 20%, and still more preferably 30%. On the other hand, in a case of a composite yarn containing a spandex, the upper limit of the elongation rate of the core yarn 51 is preferably 500%, more preferably 400%, and still more preferably 300%. In a case in which the core yarn 51 is a crimped yarn constituted from nylon, polyester, or the like, the upper limit of the elongation rate of the core yarn 51 is preferably 100% and more preferably 80%. By setting the elongation rate of the core yarn 51 to be no less than the lower limit, electrical conductivity can be easily ensured, and fit of the glove 1 can be improved. Furthermore, by setting the elongation rate of the core yarn 51 to be no greater than the upper limit, unnecessary protrusion of the electrically conductive yarn 21 from the glove 1 can be prevented, and tightness at a time of wearing the glove 1 can be prevented.

In the case in which the electrically conductive yarn 21 is the core-sheath composite yarn 50, the electrically conductive fiber is subjected to covering as an outermost layer (sheath yarn 52) with respect to the core yarn 51. The lower limit of the number of turns per unit length of the sheath yarn 52 is preferably 100 times/m and more preferably 150 times/m. On the other hand, the upper limit of the number of turns is preferably 500 times/m and more preferably 450 times/m. By setting the number of turns to fall within the above range, the volume resistance value of the electrically conductive part 20 can be controlled to fall within an appropriate range, and both explosion-proof performance and protection of an electronic component can be easily achieved.

Furthermore, the lower limit of an elongation rate of the core-sheath composite yarn 50 is preferably 7%, more preferably 10%, and still more preferably 13%. On the other hand, the upper limit of the elongation rate of the core-sheath composite yarn 50 is preferably 100%, more preferably 70%, and still more preferably 50%. By setting the elongation rate of the core-sheath composite yarn 50 to fall within the above range, electrical conductivity can be easily ensured, while preventing tightness at the time of wearing the glove 1.

Figure 5:
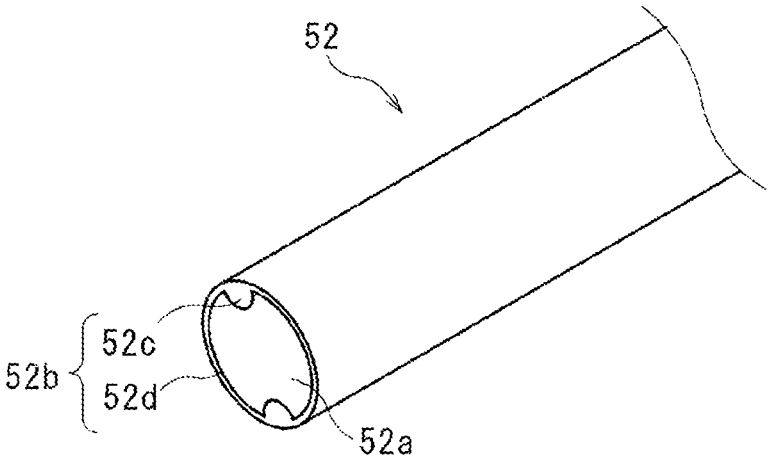
FIG. 5 is a schematic perspective view illustrating an example of a composite yarn.

As the sheath yarn 52, for example, composite fiber as illustrated in FIG. 5 which is created by a conjugate spinning method may be used. The sheath yarn 52 illustrated in FIG. 5 includes: a core component 52*a*; and a sheath component 52*b* which is electrically conductive and coats an outer periphery of the core component 52*a*. The sheath component 52*b* includes: a plurality of (in FIG. 5, a pair of) columnar portions 52*c* embedded in the outer periphery of the core component 52*a*; and a thin layer portion 52*d* connecting the plurality of columnar portions 52*c*. By thus using, as the sheath yarn 52, such composite fiber as illustrated in FIG. 5, when the electrically conductive part 20 comes into contact with an object for gripping, the electrically conductive yarn 21 is easily deformed, and the sheath component 52*b* on the outer periphery comes into contact with the object for gripping and/or a hand of a worker, whereby electrical conductivity can be easily ensured. It is to be noted that as illustrated in FIG. 5, the columnar portions 52*c* and the thin layer portion 52*d* are preferably formed in an integrated manner by using the same material. Furthermore, as the sheath yarn 52, a sheath yarn having another configuration may be used, as long as the sheath yarn is electrically conductive fiber which enables achieving the effects of the invention of the present application. Examples of the sheath yarn 52 include composite fiber constituted from only the core component 52*a* and the columnar portions 52*c* (not including the thin layer portion 52*d* in FIG. 5), composite fiber in which the columnar portion 52*c* is embedded in a central portion of the core component 52*a* (the columnar portion 52*c* is coated with the core component 52*a*), and the like.

Examples of a material of the plating yarn 22 include cotton fiber, polyester fiber, nylon fiber, polyethylene fiber, polypropylene fiber, acrylic fiber, aramid fiber, polyparaphenylene benzoxazole (PBO) fiber, ultra-high molecular weight polyethylene fiber, highly drawn polyethylene fiber, glass fiber, polyurethane elastic fiber, and natural rubber fiber; composite fiber thereof; and the like.

In light of preventing dust generation, the plating yarn 22 is preferably a filament yarn.

Furthermore, in light of imparting fitting properties to the glove 1 after knitting, the plating yarn 22 is preferably an elastic yarn. By thus using the elastic yarn as the plating yarn 22, the plating yarn 22 as well as the electrically conductive yarn 21 can be easily deformed. When the electrically conductive part 20 comes into contact with an object for gripping, deformation of the plating yarn 22 allows the electrically conductive yarn 21 to come into contact with the object for gripping and/or a hand of a worker, whereby electrical conductivity can be easily ensured.

Specific examples of the plating yarn 22 include a crimped yarn, a core-sheath composite yarn in which a spandex or natural rubber fiber is used as a core yarn, and the like. In the core-sheath composite yarn, well-known fiber may be used as the sheath yarn for covering the core yarn, but it is preferable to use nylon fiber or polyester fiber subjected to crimping, and/or high-strength polyethylene fiber such as ultra-high molecular weight polyethylene fiber or highly drawn polyethylene fiber. The core-sheath composite yarn may be a single covered yarn or a double covered yarn covered with any of these yarns.

The plating yarn 22 is particularly preferably a composite yarn containing a spandex or natural rubber fiber. By thus using, as the plating yarn 22, the composite yarn containing the spandex or the natural rubber fiber, electrical conductivity can be ensured more easily. Furthermore, the glove 1 can be imparted with comfortable fit.

In a case in which the plating yarn 22 is an elastic composite yarn, in light of improving fit of the glove 1 after knitting and in light of allowing stretchability higher than that of the electrically conductive yarn 21, a draft is preferably set to be no less than 2.0. Furthermore, in light of preventing excessively tight fastening of the glove 1, the draft is preferably set to be no greater than 4.0. Furthermore, in the case of the composite yarn in which the sheath yarn is wound on and covers the core yarn (core-sheath composite yarn), in light of maintaining flexibility of the plating yarn 22, the number of turns per unit length is preferably no less than 180 times/m and no greater than 660 times/m.

The lower limit of an elongation rate of the plating yarn 22 is preferably 15%, more preferably 30%, and still more preferably 100%. On the other hand, the upper limit of the elongation rate of the plating yarn 22 is, in the case of the crimped yarn, preferably 100% and more preferably 80%, and in the case of the spandex composite yarn, preferably 500% and more preferably 400%. When the elongation rate of the plating yarn 22 is less than the lower limit, the fit of the glove 1 may be degraded. Conversely, when the elongation rate of the plating yarn 22 is greater than the upper limit, the glove 1 at the time of wearing may be tight.

Furthermore, the elongation rate of the plating yarn 22 is preferably higher than an elongation rate of the electrically conductive yarn 21. When the elongation rate of the plating yarn 22 is thus made higher than the elongation rate of the electrically conductive yarn 21, and when the glove is released from the tension in knitting, a contracting force of the plating yarn 22 becomes greater than a contracting force of the electrically conductive yarn 21. In this case, the electrically conductive yarn 21 is twisted in a thickness direction of the glove 1 and can be easily exposed not only on the face stich side of the glove 1 but also on the back stitch side. Thus, electrical conductivity can be easily ensured.

The lower limit of a fineness of the plating yarn 22 is preferably 40 dtex and more preferably 50 dtex. On the other hand, the upper limit of the fineness of the plating yarn 22 is preferably 200 dtex and more preferably 156 dtex. When the fineness of the plating yarn 22 is less than the lower limit, the strength of the glove 1 after knitting may be insufficient. Conversely, when the fineness of the plating yarn 22 is greater than the upper limit, the glove 1 after knitting may become hard and/or the volume resistance value of the electrically conductive part 20 may become too high.

The lower limit of a fineness ratio of the electrically conductive yarn 21 to the plating yarn 22 is 1:0.5 and more preferably 1:0.7. On the other hand, the upper limit of the fineness ratio of the electrically conductive yarn 21 to the plating yarn 22 is 1:2 and more preferably 1:1.5. By setting the fineness ratio of the electrically conductive yarn 21 to the plating yarn 22 to fall within the above range, the electrically conductive yarn 21 can be easily exposed not only on the face stich side of the glove 1 but also on the back stitch side, and thus, electrical conductivity can be easily ensured. When the fineness ratio of the electrically conductive yarn 21 to the plating yarn 22 is less than the lower limit, the electrically conductive yarn 21 is likely to be excessively exposed from the back stitch side of the glove 1, and thus, the volume resistance value of the electrically conductive part 20 may become too low. Conversely, when the fineness ratio of the electrically conductive yarn 21 to the plating yarn 22 is greater than the upper limit, the electrically conductive yarn 21 is prevented from being exposed from the back stitch side of the glove 1, and thus, it may be difficult to ensure necessary electrical conductivity.

Electrically Non-Conductive Part

The electrically non-conductive part 30 consists of an electrically non-conductive yarn 31.

Examples of a material of the electrically non-conductive yarn 31 include cotton fiber, polyester fiber, nylon fiber, polyethylene fiber, polypropylene fiber, acrylic fiber, aramid fiber, polyparaphenylene benzoxazole (PBO) fiber, ultra-high molecular weight polyethylene fiber, highly drawn polyethylene fiber, glass fiber, polyurethane elastic fiber, and natural rubber fiber; composite fiber thereof; and the like.

In light of preventing dust generation, the electrically non-conductive yarn 31 is preferably a filament yarn. Furthermore, in light of imparting fitting properties to the glove 1 after knitting, the electrically non-conductive yarn 31 is preferably an elastic yarn.

Specifically, the electrically non-conductive yarn 31 is preferably any of a nylon yarn subjected to crimping, a polyester yarn subjected to crimping, and a core-sheath composite yarn in which a spandex is used as a core yarn. In the case of adopting the core-sheath composite yarn as the electrically non-conductive yarn 31, a filament yarn of nylon fiber, polyester fiber, or high-strength polyethylene fiber is preferably used as the sheath yarn.

The lower limit of a fineness of the electrically non-conductive yarn 31 is preferably 70 dtex and more preferably 100 dtex. On the other hand, the upper limit of the fineness of the electrically non-conductive yarn 31 is preferably 300 dtex, more preferably 240 dtex, and still more preferably 200 dtex. When the fineness of the electrically non-conductive yarn 31 is less than the lower limit, the strength of the glove 1 having been knitted may be degraded. Conversely, when the fineness of the electrically non-conductive yarn 31 is greater than the upper limit, the glove 1 after knitting may become hard.

The lower limit of a fineness ratio of the electrically non-conductive yarn 31, which constitutes the electrically non-conductive part 30, to the electrically conductive yarn 21 contained in the electrically conductive part 20 is 1:0.4 and more preferably 1:0.5. On the other hand, the upper limit of the fineness ratio is 1:1 and more preferably 1:0.9. By setting the fineness ratio to fall within the above range, a controlled volume resistance value can be given to the repeating structure 40 of the glove 1. When the fineness ratio is less than the lower limit, the volume resistance value of the repeating structure 40 tends to become higher. It is considered that a probable reason for this is that when the knitting is switched from the electrically conductive part 20 to the electrically non-conductive part 30, or from the electrically non-conductive part 30 to the electrically conductive part 20, the electrically conductive yarn 21 becomes less likely to be exposed from the back stitch side. Furthermore, when the volume resistance value of the repeating structure 40 becomes higher, the worker may be susceptible to electrification. Conversely, when the fineness ratio is greater than the upper limit, the glove 1 having been knitted may become stiff and workability may be degraded, and in addition, the volume resistance value of the repeating structure 40 may become too low.

The lower limit of a fineness ratio of the fineness of the electrically non-conductive yarn 31, which constitutes the electrically non-conductive part 30, to a total fineness of the electrically conductive yarn 21 and the plating yarn 22, which constitute the electrically conductive part 20, is preferably 1:0.9 and more preferably 1:1. On the other hand, the upper limit of the fineness ratio is preferably 1:2 and more preferably 1:1.6. By setting the fineness ratio to fall within the above range, cutting due to abrasion of the electrically conductive yarn 21 can be easily prevented, and the volume resistance value of the repeating structure 40 can be controlled to fall within an appropriate range, whereby both explosion-proof performance and protection of an electronic component can be easily achieved.

Finger-Receiving Portion and Cuff Portion

The finger-receiving portions 10*b* and the cuff portion 10*c* may consist of only the electrically conductive part 20 or only the electrically non-conductive part 30, or may have the repeating structure 40 as in the main body portion 10*a*. It is also possible for the finger-receiving portions 10*b* to have a structure different from that of the cuff portion 10*c*. For example, in a case of intended usage in at a work site at which a touch panel is used, the finger-receiving portions 10*b* may be knitted as the electrically conductive part 20.

The finger-receiving portions 10*b* and the cuff portion 10*c* may adopt a configuration similar to that of the electrically conductive part 20 or the electrically non-conductive part 30. Furthermore, at a time of knitting, an elastic yarn containing a natural rubber, polyurethane, etc. as a material may be used together to impart stretchability. Yarn(s) to be used in the finger-receiving portions 10*b* and the cuff portion 10*c* may be selected as appropriate in accordance with the intended usage.

Method for Manufacturing Glove

The glove 1 can be manufactured by a manufacturing method including a preparing step, a knitting step, and an inside-out turning step.

Preparing Step

In the preparing step, the electrically conductive yarn 21, the plating yarn 22, and the electrically non-conductive yarn 31 are prepared.

The electrically conductive yarn 21, the plating yarn 22, and the electrically non-conductive yarn 31 to be prepared are as described above, and therefore, detailed description thereof is omitted.

Knitting Step

In the knitting step, the glove main body 10 is knitted with a flat knitting machine by using the yarns prepared in the preparing step.

As a knitting machine used for knitting the glove main body 10, an existing flat knitting machine may be used. Examples of the knitting machine include a flat knitting machine SFG-i and a computer flat knitting machine SWG, which are manufactured by SHIMA SEIKI MFG., LTD., and the like.

The lower limit of the number of gauges of the knitting machine is preferably 13 and more preferably 18. On the other hand, the upper limit of the number of gauges of the knitting machine is preferably 26.

The lower limit of the number of courses per unit length of the glove main body 10 having been knitted is preferably 30 courses/inch and more preferably 40 courses/inch. On the other hand, the upper limit of the number of courses per unit length is preferably 60 courses/inch and more preferably 55 courses/inch. By setting the number of courses per unit length to be no less than the lower limit, the interval between the electrically conductive parts 20 being adjacent to each other can be narrowed, thereby stabilizing an explosion-proof function. Furthermore, by setting the number of courses per unit length to be no greater than the upper limit, excessively tight stitches can be prevented, stretchability can be imparted to the glove main body 10, and the glove 1 can easily fit when the hand is bent or stretched.

For example, in the case of using SFG-i as the knitting machine, as yarn feeders which can be used for knitting the glove main body 10, there are a main yarn feeder, a plating yarn feeder, and a two-color switching feeder (color yarn feeder), to which, for example, the core-sheath composite yarn 50 as the electrically conductive yarn 21, the plating yarn 22, and the electrically non-conductive yarn 31 are preferably fed, respectively. Hereafter, description is made taking an example of a case in which SFG-i is used as the knitting machine and the above-described setting is performed; however, this example does not mean that the knitting machine is limited to SFG-i, or that the electrically conductive yarn 21 is limited to the core-sheath composite yarn 50.

The core-sheath composite yarn 50 being the electrically conductive yarn 21, and the plating yarn 22 are knitted by plating knitting. That is to say, the core-sheath composite yarn 50 being the electrically conductive yarn 21 is disposed on the face stich side, while the plating yarn 22 is disposed on the back stitch side. When the core-sheath composite yarn 50 is compared with the plating yarn 22, an amount of shrinkage of the plating yarn 22 after knitting is preferably larger. This makes the core-sheath composite yarn 50 likely to bend, also toward the back stitch side, and as a result, a glove having a relatively low volume resistance value can be obtained. The amount of shrinkage of the plating yarn 22 can be made larger than that of the core-sheath composite yarn 50 by setting the elongation rate of each yarn as described above. Furthermore, the amount of shrinkage can also be controlled by applying, at a time of feeding the yarns to the knitting machine, a higher tension to the plating yarn 22 than the core-sheath composite yarn 50 and by allowing the plating yarn 22 which is elongated relatively largely at the time of knitting, to shrink when the glove is completed.

Furthermore, during the knitting, by switching between: the core-sheath composite yarn 50 being the electrically conductive yarn 21 and the plating yarn 22; and the electrically non-conductive yarn 31, the electrically conductive part 20 and the electrically non-conductive part 30 can be alternately formed. Specifically, this operation can be implemented in the following manner: after knitting the electrically conductive part 20 by using the main yarn feeder and the plating yarn feeder, these feeders are both stopped, and then, the electrically non-conductive part 30 is knitted using the two-color switching feeder. At this time, the electrically non-conductive part 30 is flat-knitted using one feeder. Accordingly, the electrically conductive part 20 is knitted by plating knitting of two types of yarns and is bulkier than the electrically non-conductive part 30 which is flat-knitted, and at a boundary between the electrically conductive part 20 and the electrically non-conductive part 30, the core-sheath composite yarn 50 being the electrically conductive yarn 21 is easily exposed on the back stitch side. Thus, the glove 1 having been knitted can be a glove having a relatively low volume resistance value. This can also be achieved by, aside from respectively configuring the yarns to be used as described above, making a size of stitches of the electrically non-conductive part 30 smaller than that of the electrically conductive part 20 (the value of the stitch cam adjusting knob of the knitting machine) and/or increasing a tension of the yarn fed to the electrically non-conductive part 30.

It is to be noted that the volume resistance value is controlled by, in addition to the configurations of the yarns to be used, the number of courses of the electrically conductive part 20 and the electrically non-conductive part 30 as described above.

Inside-Out Turning Step

In the inside-out turning step, the glove main body 10 after the knitting step is turned inside out. Thus, the glove 1 desired can be obtained.

The glove main body 10 having been knitted is inverted such that face stitches are in contact with the palm of the wearer and back stitches are in contact with an object for gripping. In this case, compression pressure is applied to the glove 1 due to gripping, the plating yarn 22 on the back stitch side is crushed, and the electrically conductive yarn 21 easily protrudes on the object side, whereby the volume resistance value of the electrically conductive part 20 can be reduced. On the other hand, when the compression of the glove 1 due to gripping does not occur, the electrically conductive yarn 21 is less likely to protrude on the surface of the glove 1, and the electrically conductive yarn 21 is less likely to be abraded or cut by a sharp object, whereby a longer lifetime of the glove 1 can be achieved.

Advantages

In the glove 1, the electrically conductive yarn 21 and the electrically non-conductive plating yarn 22 of the electrically conductive part 20 are subjected to plating knitting, and the fineness ratio thereof is no less than 1:0.5 and no greater than 1:2. In this case, when the electrically conductive part 20 comes into contact with an object for gripping, the electrically conductive yarn 21 is exposed on both the outer face and the inner face of the glove 1 due to deformation of the electrically conductive yarn 21 and the plating yarn 22, whereby electrical conductivity between the outer face and the inner face of the glove 1 can be ensured. Furthermore, in the glove 1, by setting the fineness ratio of the electrically non-conductive yarn 31, which constitutes the electrically non-conductive part 30, to the electrically conductive yarn 21 contained in the electrically conductive part 20 to be no less than 1:0.4 and no greater than 1:1, when the electrically conductive part 20 comes into contact with an object for gripping, strong contact of the electrically conductive yarn 21 with the object for gripping and/or a hand of a worker can be inhibited, and an excessive decrease in the volume resistance value of the electrically conductive part 20 can be inhibited. Thus, in the glove 1, the electrically conductive part 20 can be disposed such that the ratio of the number of courses of the electrically conductive part 20 to the number of courses of the electrically non-conductive part 30, the electrically conductive part 20 and the electrically non-conductive part 30 being adjacent to each other, is no less than 1:2 and no greater than 1:6, i.e., the electrically conductive part 20 can be repeatedly disposed at an appropriate frequency; therefore, even when the contact position with the object for gripping varies, the volume resistance value of the repeating structure 40 easily falls within the certain range. Furthermore, the glove 1 does not require use of a special yarn and thus enables inhibiting a rise in manufacturing cost.

Other Embodiments

The present invention is not limited to the above embodiments and may be carried out in various modified and improved modes in addition to the aforementioned modes.

In the above embodiment, the configuration in which the face stitches of the electrically conductive part are positioned on the glove inner face side and the back stitches are positioned on the glove outer face side has been described; however, a configuration in which the face stitches of the electrically conductive part are positioned on the glove outer face side and the back stitches are positioned on the glove inner face side also falls within the intended scope of the present invention. It is to be noted that, as described above, the configuration in which the face stitches of the electrically conductive part are positioned on the glove inner face side and the back stitches are positioned on the glove outer face side is preferred in light of the lifetime of the glove.

As needed, for example, the palm part of the glove main body may be coated with a resin or a rubber having a volume resistance value of less than $10^8\Omega$. Even a glove which comes into contact with an object for gripping through the electrically conductive coating can have similar effects.

In the above embodiment, the case in which the electrically non-conductive part is flat-knitted has been described; however, a glove including an electrically non-conductive part which is obtained by plating knitting also falls within the intended scope of the present invention. It is to be noted that, as described above, the electrically non-conductive part is preferably flat-knitted in light of the volume resistance value.

Examples

Hereafter, the present invention is described further in detail by way of Examples; however, the invention is not limited to the Examples below.

Preparing Step

The following yarns were prepared.

Electrically Conductive Yarn

As the electrically conductive yarn, a core-sheath composite yarn (elongation rate of the yarn: 16%) obtained by covering a single yarn of wooly nylon of 77 dtex (elongation rate of the yarn: 45%) as the core yarn with an electrically conductive yarn of 22 dtex (Clacarbo, manufactured by Kuraray Co., Ltd.) as the sheath yarn at 200 times/m was prepared.

Plating Yarn

As the plating yarn, a core-sheath composite yarn (elongation rate of the yarn: 220%) was prepared, which was obtained by covering a polyurethane elastic yarn of 22 dtex as the core yarn with a single yarn of wooly nylon of 77 dtex as the sheath yarn at a draft of 3.0 and 400 times/m.

Electrically Non-Conductive Yarn

As the electrically non-conductive yarn, a two-folded yarn of wooly nylon of 77 dtex (elongation rate of the yarn: 50%) was prepared.

Knitting

A glove main body was knitted using an 18G flat knitting machine (SFG-i, manufactured by SHIMA SEIKI MFG., LTD.) in such a manner that the electrically conductive yarn was fed to a main yarn feeder, the plating yarn was fed to a plating yarn feeder, and the electrically non-conductive composite yarn was fed to a two-color switching feeder.

Figure 6:
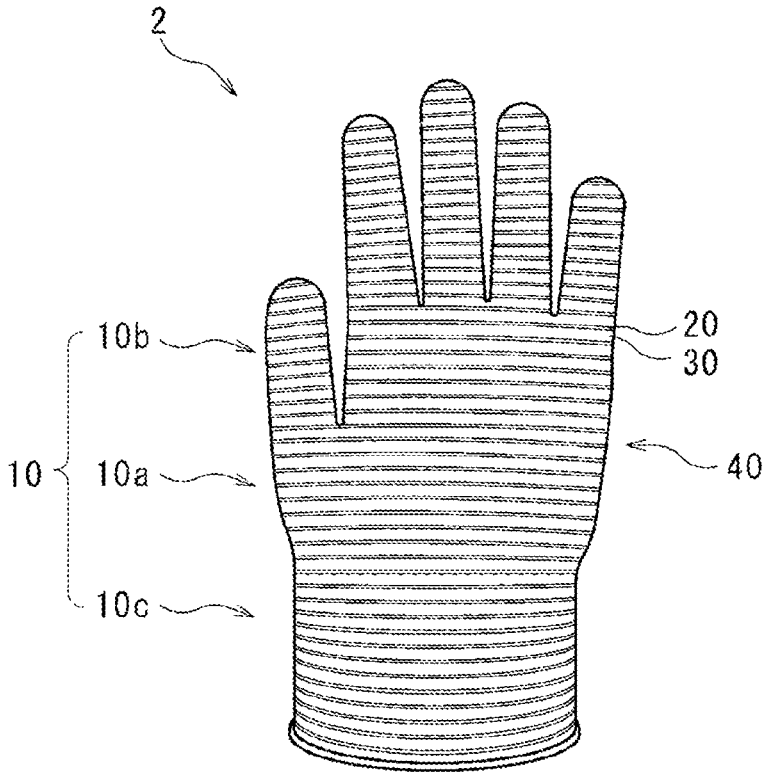
FIG. 6 is a schematic perspective view from a palm side of a glove in Examples.

As illustrated in FIG. 6, in the glove main body 10 of a glove 2 in the Example, the main body portion 10*a*, the finger-receiving portions 10*b*, and the cuff portion 10*c* were knitted to have the repeating structure 40. Specifically, the main body portion 10*a* and the finger-receiving portions 10*b* were knitted by a repeating operation in which the main yarn feeder and the plating yarn feeder were moved by 1 course and then the two-color switching feeder was moved by 4 courses. The cuff portion 10*c* was knitted by, in addition to the repeating operation, inlay knitting of a rubber yarn (yarn obtained by covering a natural rubber core yarn of 330 dtex with a polyester yarn of 83 dtex) in a proportion of 1 course to 3 courses. It is to be noted that the number of courses per unit length of the palm part was set to 42 courses/inch.

The glove main body 10 after the knitting was turned inside out to obtain the glove desired.

When a volume resistance value of the glove 2 was measured in conformity with EN 61340-2-3, the volume resistance value was $1.8\times10^{4}\Omega$, and the surface resistance value was $3.5\times10^{4}\Omega$.

INDUSTRIAL APPLICABILITY

As described above, while inhibiting a rise in manufacturing cost, the glove of the present invention has a volume resistance value that easily falls within a certain range, even when a contact position with an object for gripping varies.

EXPLANATION OF THE REFERENCE SYMBOLS

1, 2 Glove
10 Glove main body
10*a* Main body portion
10*b* Finger-receiving portion
10*c* Cuff portion
20 Electrically conductive part
21 Electrically conductive yarn
22 Plating yarn
30 Electrically non-conductive part
31 Electrically non-conductive yarn
40 Repeating structure
50 Core-sheath composite yarn
51 Core yarn
52 Sheath yarn
52*a* Core component
52*b* Sheath component
52*c* Columnar portion
52*d* Thin layer portion

What is claimed is:

1. A glove comprising:

a glove main body knitted with a yarn made of fiber, the glove main body comprising:
a main body portion;
five finger-receiving portions each having a bottomed cylindrical shape; and
a cylindrical cuff portion, wherein the main body portion is formed into a bag shape to cover a palm and a dorsal side of a wearer's hand, the five finger-receiving portions extend from the main body portion to cover each of a first finger to a fifth finger of the wearer, and the cuff portion extends in a direction opposite to the five finger-receiving portions, in at least a part of a palm part, the main body portion comprises a repeating structure of: a strip-shaped electrically conductive part comprising an electrically conductive yarn; and a strip-shaped electrically non-conductive part not comprising the electrically conductive yarn, a ratio of a number of courses of the electrically conductive part to a number of courses of the electrically non-conductive part, the electrically conductive part and the electrically non-conductive part being adjacent to each other, is no less than 1:3 and no greater than 1:6, the electrically conductive part is constituted by plating knitting of the electrically conductive yarn and an electrically non-conductive plating yarn, a fineness ratio of the electrically conductive yarn to the electrically non-conductive plating yarn is no less than 1:0.5 and no greater than 1:2, a fineness ratio of an electrically non-conductive yarn, which constitutes the electrically non-conductive part, to the electrically conductive yarn comprised in the electrically conductive part is no less than 1:0.4 and no greater than 1:1, and the number of courses of the electrically conductive part is no less than 1 course and no greater than 3 courses.

2. The glove according to claim 1, wherein the electrically conductive yarn is a core-sheath composite yarn, and a core yarn of the core-sheath composite yarn is constituted by electrically non-conductive elastic fiber, and a sheath yarn of the core-sheath composite yarn comprises electrically conductive fiber.

3. The glove according to claim 2, wherein the elastic fiber is nylon fiber or polyester fiber subjected to crimping, and an elongation rate of the elastic fiber is no less than 10% and no greater than 100%.

4. The glove according to claim 1, wherein the electrically non-conductive plating yarn is an elastic yarn.

5. The glove according to claim 4, wherein the electrically non-conductive plating yarn is a composite yarn comprising spandex fiber or natural rubber fiber.

6. The glove according to claim 1, wherein in the repeating structure, a volume resistance value specified in EN 61340-2-3 is no less than $3.5\times10^{3}\Omega$ and no greater than $1.0\times10^{8}\Omega$.

7. The glove according to claim 6, wherein in the repeating structure, a surface resistance value specified in EN 61340-2-3 is no less than $3.5\times10^{3}\Omega$ and no greater than $1.0\times10^{8}\Omega$.

* * * * *